US007209131B2

(12) United States Patent
Matsumoto

(10) Patent No.: US 7,209,131 B2
(45) Date of Patent: Apr. 24, 2007

(54) DISPLAY AND METHOD OF CONTROLLING THE SAME

(75) Inventor: Shoichiro Matsumoto, Ogaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 311 days.

(21) Appl. No.: 10/152,010

(22) Filed: May 22, 2002

(65) Prior Publication Data

US 2002/0175909 A1 Nov. 28, 2002

(30) Foreign Application Priority Data

May 23, 2001 (JP) ..... 2001-153680

(51) Int. Cl.
*G09G 5/00* (2006.01)

(52) U.S. Cl. ..... 345/211; 345/98

(58) Field of Classification Search ..... 345/211, 345/90, 82, 533, 98, 100, 204–206
See application file for complete search history.

(56) References Cited

U.S. PATENT DOCUMENTS 5,712,652 A * 1/1998 Sato et al. ..... 345/90
5,850,231 A * 12/1998 Orimoto et al. ..... 345/533
5,952,991 A * 9/1999 Akiyama ..... 345/98
6,552,980 B2 * 4/2003 Yamazaki ..... 369/47.5
6,563,480 B1 * 5/2003 Nakamura ..... 345/82

FOREIGN PATENT DOCUMENTS

| | | | |
|---|---|---|---|
| JP | 7-159754 | | 6/1995 |
| JP | 9-68951 | | 3/1997 |
| JP | 09-068951 | * | 3/1997 |
| JP | 9-212140 | | 8/1997 |

* cited by examiner

*Primary Examiner*—Richard Hjerpe
*Assistant Examiner*—Kevin M. Nguyen
(74) *Attorney, Agent, or Firm*—McDermott Will & Emery LLP

(57) ABSTRACT

A display capable of excellently writing data when making transition to a standby operation mode is obtained. This display comprises a pixel part having a memory, a power supply circuit formed on the same substrate as the pixel part for operating the memory and a control circuit writing data in the memory after the voltage of the power supply circuit reaches a prescribed value. Thus, the control circuit writing the data in the memory after the voltage of the power supply circuit reaches the set value is so provided that the power supply circuit completely rises and a through current is suppressed in data writing, whereby the data is excellently written in the memory.

19 Claims, 11 Drawing Sheets

DISPLAY AND METHOD OF CONTROLLING THE SAME

BACKGROUND OF THE INVENTION

1. Field of the Invention

The present invention relates to a display and a method of controlling the same, and more particularly, it relates to a display having a memory in a pixel part and a method of controlling the same.

2. Description of the Background Art

Demand for a miniature liquid crystal display (LCD) employing polysilicon TFTs (thin-film transistors) is recently increased. Therefore, power consumption in a display system including a liquid crystal panel and an external control IC must be reduced. Particularly in a liquid crystal display carried on a portable telephone driven by a cell, power consumption must be reduced. Therefore, the liquid crystal display employed for the portable telephone must also be reduced in power consumption, particularly in a wait screen in a wait state.

In order to reduce power consumption in the wait screen of the liquid crystal display carried on the potable screen, various technical developments are made by turning off a backlight, employing a partial display system of displaying necessary information only on part of the LCD screen etc.

In order to reduce power consumption in the wait screen, an LCD having a built-in memory is proposed as a system storing a memory such as an SRAM (static random access memory) in a pixel part of the LCD while stopping driving by a peripheral circuit in a wait state thereby implementing low power consumption.

The LCD having a built-in memory includes three operation modes, i.e., an operation mode in general application, an operation mode for writing video data to be displayed in a wait state and an operation mode in a standby state. In the general application, the LCD operates on the basis of basic clocks consisting of horizontal and vertical clocks. In other words, the LCD writes video data in pixels through a data line driving circuit and a scanning line driving circuit arranged around the pixels in the general application operation mode.

In the operation mode for writing the video data to be displayed in the wait state, the LCD writes the video data in the memory before making transition to the standby state. In the operation mode in the standby state, the LCD writes video data to be displayed in the standby state from the memory in the liquid crystals.

The aforementioned conventional LCD having a built-in memory (SRAM) writes the video data in the memory when making transition to the standby state, and hence the memory is activated in the wait state and the standby state and inactivated in the general application. When a power supply circuit for driving the memory is started when the memory makes transition from the inactive state for general application to an active state in the standby state in this case, a through current flows to the memory (SRAM), to disadvantageously increase current consumption.

When starting of the power supply circuit for driving the memory and data writing are simultaneously performed when the memory makes transition from the inactive state for general application to the active state in the standby state, it is disadvantageously difficult to write data due to the through current of the aforementioned memory (SRAM).

SUMMARY OF THE INVENTION

An object of the present invention is to provide a display capable of excellently writing data when making transition to a standby operation mode.

Another object of the present invention is to suppress increase of current consumption caused when making transition between operation modes in the aforementioned display.

Still another object of the present invention is to provide a method of controlling a display capable of excellently writing data when making transition to a standby operation mode.

A further object of the present invention is to suppress increase of current consumption caused when making transition between operation modes in the aforementioned method of controlling a display.

In order to attain the aforementioned objects, a display according to a first aspect of the present invention comprises a pixel part having a memory, a power supply circuit formed on the same substrate as the pixel part for operating the memory and a control circuit writing data in the memory after the voltage of the power supply circuit reaches a set value.

The display according to the first aspect is provided with the control circuit writing the data in the memory after the voltage of the power supply circuit reaches the set value as hereinabove described so that the power supply circuit completely rises to suppress a through current when writing the data, whereby the data can be excellently written in the memory.

In the aforementioned display according to the first aspect, the power supply circuit preferably includes at least a positive voltage generation circuit, a power source having higher current drivability than the positive voltage generation circuit is employed as the power source for the memory while the data is written in the memory, and the positive voltage generation circuit is employed as the power source for the memory after the data is completely written. When a stable power source having high current drivability is employed for data writing as described above, the power source is not unstabilized even if a through current flows in data writing. Thus, the data can be stably written. When a stable power source having high current drivability is employed for data writing, further, the potential of the positive voltage generation circuit is not disadvantageously rapidly reduced due to a through current when writing the data in the memory. The through current hardly flows in a standby state after the data writing, and hence current consumption can be reduced in the standby state. In this case, the power source having higher current drivability than the positive voltage generation circuit may include either a display panel power source VDD or a standby power source VCC.

In the aforementioned display according to the first aspect, the power supply circuit preferably includes a positive voltage generation circuit and a negative voltage generation circuit, and the negative voltage generation circuit is preferably connected to the memory after temporarily setting a node of the positive voltage generation circuit to a ground potential thereby discharging the same when making transition from a standby operation mode to a general application operation mode. When the negative voltage generation circuit is connected to the memory after temporal discharging as described above, increase of current consumption can be suppressed when making transition from the standby operation mode to the general application operation mode while reducing the time when a negative potential is unstabilized.

In the aforementioned display according to the first aspect, the control circuit preferably includes an external control circuit for transferring still picture data and a control signal to the memory when writing the data in the memory. According to this structure, the data can be readily written in the memory through the external control circuit. In this case, the external control circuit may further transmit a signal for starting the power supply circuit to the power supply circuit. According to this structure, the power supply circuit can be readily started through the external control circuit also when the power supply circuit is started after sensing the standby mode, for example.

In the aforementioned display according to the first aspect, the memory may include an SRAM. Further, the display may include either a liquid crystal display or an EL display.

A method of controlling a display according to a second aspect of the present invention is a method of controlling a display comprising a pixel part having a memory and a power supply circuit formed on the same substrate as the pixel part for operating the memory, which comprises steps of making the voltage of the power supply circuit reach a set value and writing data in the memory after the voltage of the power supply circuit reaches the set value.

In the method of controlling a display according to the second aspect, the data is written in the memory after the voltage of the power supply circuit reaches the set value as hereinabove described, whereby the power supply circuit completely rises with no through current in data writing and hence the data can be excellently written in the memory.

In the aforementioned method of controlling a display according to the second aspect, the step of writing the data in the memory preferably includes a step of transferring still picture data and a control signal to the memory thereby writing the data. According to this structure, the data can be readily written in the memory.

In the aforementioned method of controlling a display according to the second aspect, the step of making the voltage of the power supply circuit reach the set value preferably includes a step of transmitting a setup completion signal from the power supply circuit to the control circuit thereby sensing that the voltage of the power supply circuit reaches the set value. According to this structure, it is possible to readily sense that the voltage of the power supply circuit reaches the set value.

In the aforementioned method of controlling a display according to the second aspect, the step of making the voltage of the power supply circuit reach the set value preferably includes a step of sensing that the voltage of the power supply circuit reaches the set value on the basis of a lapse of a prescribed time after starting of the power supply circuit. According to this structure, it is possible to readily sense that the voltage of the power supply circuit reaches the set value.

In the aforementioned method of controlling a display according to the second aspect, the step of making the voltage of the power supply circuit reach the set value preferably includes a step of starting the power supply circuit simultaneously with power supply to a display panel, and the step of writing the data in the memory preferably includes a step of performing operation in a general application operation mode after the voltage of the power supply circuit reaches the set value and thereafter writing the data in the memory when making transition to a standby operation mode. According to this structure, the power supply circuit completely rises with no through current when making transition to the standby operation mode after the operation in the general application operation mode, whereby the data can be excellently written.

In the aforementioned method of controlling a display according to the second aspect, the step of making the voltage of the power supply circuit reach the set value preferably includes a step of starting the power supply circuit after transition to a standby operation mode is sensed, and the step of writing the data in the memory preferably includes a step of writing the data in the memory after the voltage of the power supply circuit reaches the set value in the standby operation mode. According to this structure, the power supply circuit completely rises with no through current when writing data in the memory also when the power supply circuit is started after sensing transition to the standby operation mode, whereby the data can be excellently written.

In this case, the step of making the voltage of the power supply circuit reach the set value may include a step of transmitting a setup completion signal from the power supply circuit to the control circuit thereby sensing that the voltage of the power supply circuit reaches the set value, and the step of making the voltage of the power supply circuit reach the set value may include a step of sensing that the voltage of the power supply circuit reaches the set value on the basis of a lapse of a prescribed time after starting of the power supply circuit. According to this structure, it is possible to readily sense that the voltage of the power supply circuit reaches the set value.

In the aforementioned method of controlling a display according to the second aspect, the power supply circuit preferably includes at least a positive voltage generation circuit, and the step of writing the data in the memory preferably includes a step of employing a power source having higher current drivability than the positive voltage generation circuit as the power source for the memory while writing the data in the memory and employing the positive voltage generation circuit as the power source for the memory after writing the data. When a stable power source having high current drivability is employed for data writing as described above, the power source is not unstabilized even if a through current flows in the data writing. Thus, the data can be stably written. When a stable power source having high current drivability is employed for data writing, further, the potential of the positive voltage generation circuit is not disadvantageously rapidly reduced due to a through current when writing the data in the memory. No through current flows in a standby state after the data writing, and hence current consumption can be reduced in the standby state. In this case, the power source having higher current drivability than the positive voltage generation circuit may include either a display panel power source VDD or a standby power source VCC.

In the aforementioned method of controlling a display according to the second aspect, the power supply circuit preferably includes a positive voltage generation circuit and a negative voltage generation circuit, and the method preferably further includes a step of connecting the negative voltage generation circuit to the memory after temporarily setting a node of the positive voltage generation circuit to a ground potential thereby discharging the same when making transition from a standby operation mode to a general application operation mode. When the negative voltage generation circuit is connected to the memory after temporal discharging as described above, increase of current consumption can be suppressed when making transition from the standby operation mode to the general application operation mode while reducing the time when a negative potential is unstabilized.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

(First Embodiment)

Figure 1:
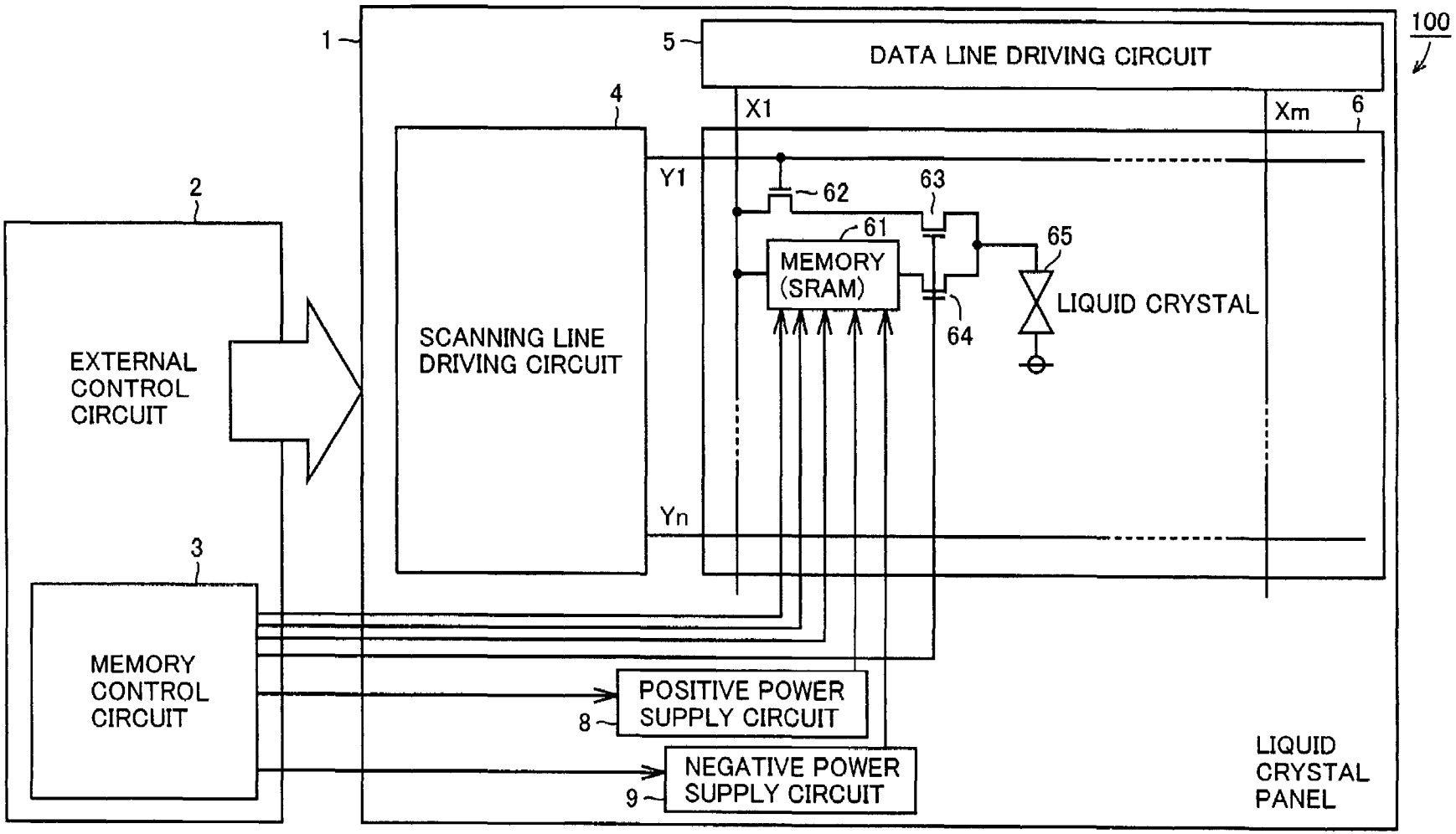
FIG. 1 is a block diagram showing the overall structure of a liquid crystal display according to a first embodiment of the present invention.

The overall structure of a liquid crystal display 100 according to a first embodiment of the present invention is described with reference to FIG. 1. The liquid crystal display 100 according to the first embodiment comprises a liquid crystal panel 1 and an external control circuit 2. The external control circuit 2 is an example of the "control circuit" according to the present invention. The liquid crystal panel 1 includes a scanning line driving circuit 4, a data line driving circuit 5, a pixel part (display part) 6, a positive power supply circuit (positive voltage generation circuit) 8 and a negative power supply circuit (negative voltage generation circuit) 9. According to the first embodiment, the pixel part 6, the positive voltage generation circuit 8 and the negative voltage generation circuit 9 are formed on the same substrate (the same liquid crystal panel 1).

Each pixel forming the pixel part 6 includes a memory 61 consisting of an SRAM, transistors 62, 63 and 64 and a liquid crystal 65. Such pixels are arranged in the form of a matrix in the pixel part 6. The memory 61 has a function of storing still picture data to be displayed in a wait state and writing the still picture to be displayed in the wait state in the liquid crystal 65 through the transistor 64. The external control circuit 2 includes a memory control circuit 3 controlling the memory 61.

Figure 2:
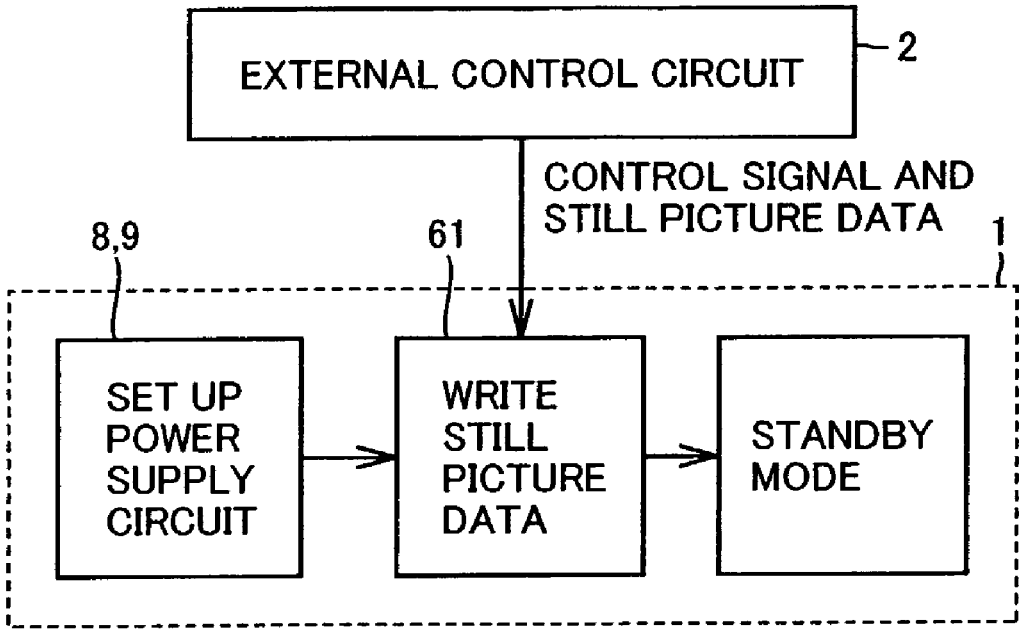
FIG. 2 is a block diagram for illustrating a method of controlling a liquid crystal display according to the first embodiment of the present invention.
Figure 3:
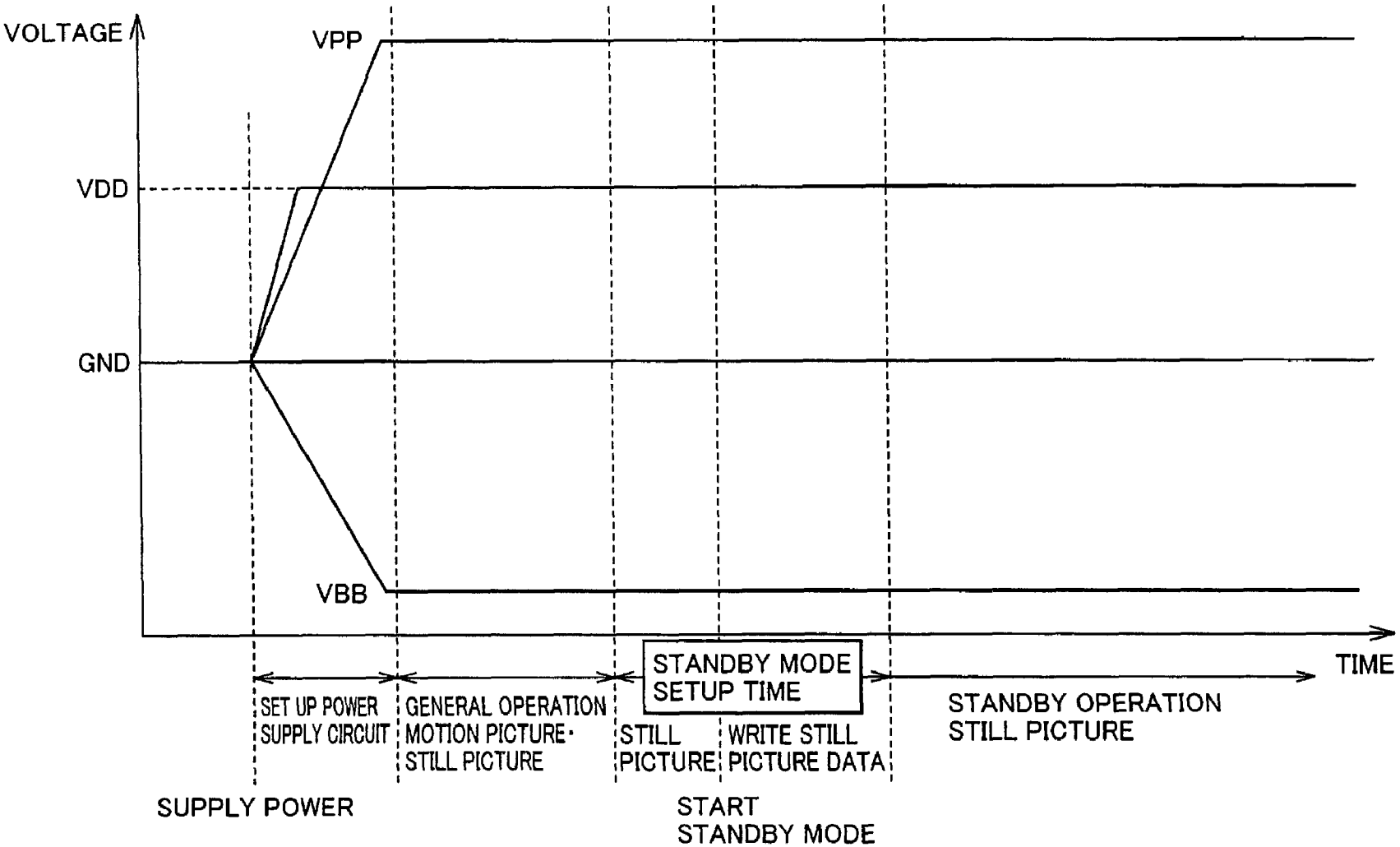
FIG. 3 is a schematic diagram for illustrating starting order for power supply circuits in the method of controlling a liquid crystal display according to the first embodiment shown in FIG. 2.

A method of controlling the liquid crystal display according to the first embodiment is now described with reference to FIGS. 2 and 3. According to the first embodiment, the positive voltage generation circuit 8 and the negative voltage generation circuit 9 are set up simultaneously when a power source (VDD) is supplied to the liquid crystal panel 1, as shown in FIGS. 2 and 3. After the positive voltage generation circuit 8 reaches a stepped-up voltage (VPP) and the negative voltage generation circuit 9 reaches an ultimate voltage (VBB), the liquid crystal display 100 enters a general application operation mode. After performing operation in the general application operation mode, the liquid crystal display 100 senses that a control system (not shown) for the liquid crystal panel 1 is in a standby mode. After writing still picture data on the basis of this sensing, the liquid crystal display 100 enters a standby operation mode.

The external control circuit 2 has a function of transferring a control signal necessary for writing a still picture and the still picture data to the memory 61 on the basis of the control system (not shown) for the liquid crystal panel 1 sensing the standby operation mode (standby mode).

According to the first embodiment, the liquid crystal display 100 performs the operation in the general application operation mode after the voltages of the positive voltage generation circuit 8 and the negative voltage generation circuit 9 for operating the memory 61 reach the set values VPP and VBB respectively and thereafter writes data in the memory 61 when making transition to the standby mode, whereby the positive voltage generation circuit 8 and the negative voltage generation circuit 9 completely rise for suppressing a through current in data writing. Consequently, the still picture data can be excellently written in the memory 61.

(Second Embodiment)

Figure 4:
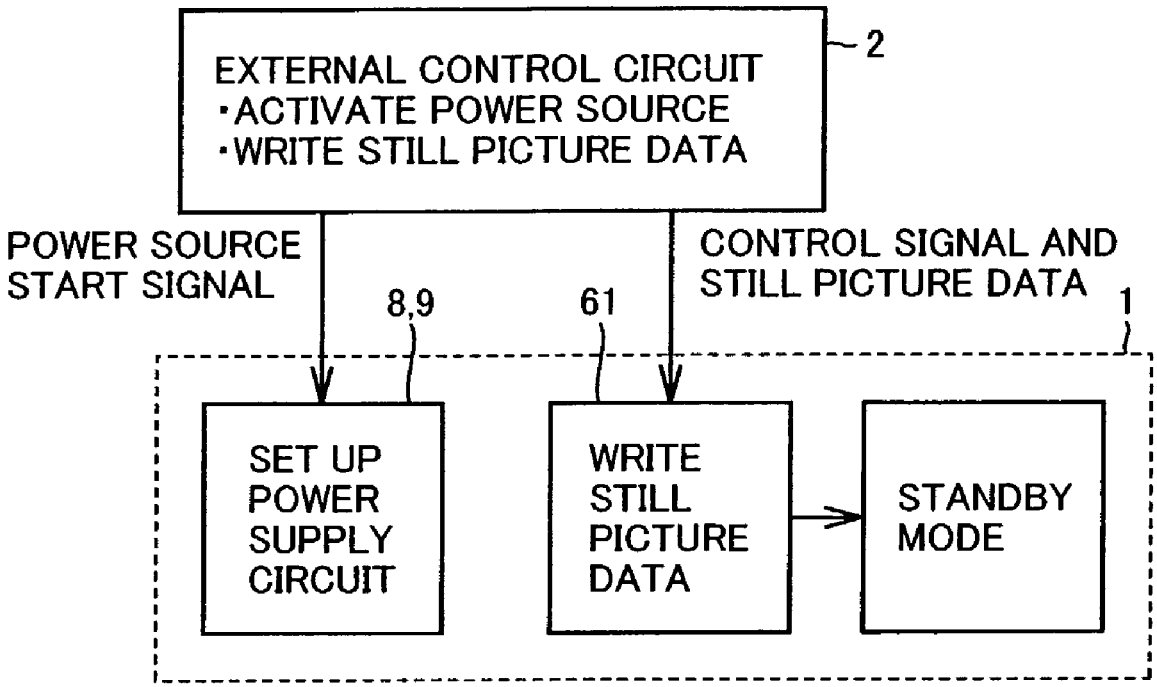
FIG. 4 is a block diagram for illustrating a method of controlling a liquid crystal display according to a second embodiment of the present invention.
Figure 5:
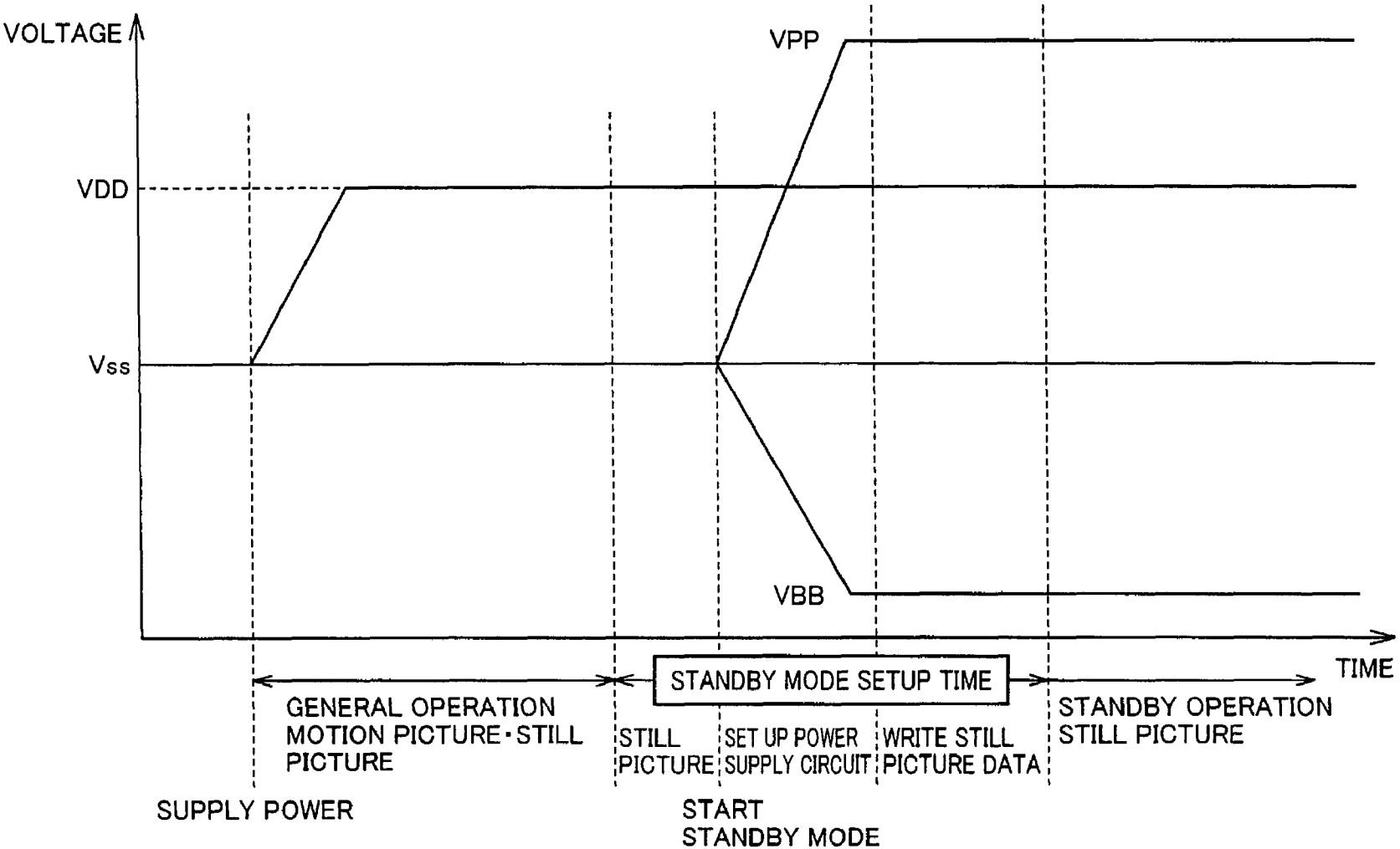
FIG. 5 is a schematic diagram for illustrating starting order for power supply circuits in the method of controlling a liquid crystal display according to the second embodiment shown in FIG. 4.

Referring to FIGS. 4 and 5, power supply circuits are started after sensing a standby mode in a liquid crystal display according to a second embodiment of the present invention, dissimilarly to the aforementioned first embodiment. The liquid crystal display according to the second embodiment is now described in detail.

According to the second embodiment, a power source (VDD) is first supplied to a liquid crystal panel 1 for performing operation (general operation) in a general application operation mode. After the general operation, the liquid crystal display starts a positive voltage generation circuit (positive power supply circuit) 8 and a negative voltage generation circuit (negative power supply circuit) 9 before making transition to the standby mode on the basis of a control system (not shown) for the liquid crystal panel 1 sensing the standby mode. In this case, an external control circuit 2 transmits a power supply starting signal to the positive voltage generation circuit 8 and the negative voltage generation circuit 9 thereby starting setting up the positive voltage generation circuit 8 and the negative voltage generation circuit 9, as shown in FIG. 4. After the voltages of the positive voltage generation circuit 8 and the negative voltage generation circuit 9 reach set levels VPP and VBB respectively, the liquid crystal display writes still picture data in a memory 61 and thereafter enters the standby operation mode (standby mode). When writing the still picture data in the memory 61, the external control circuit 2 transfers a control signal necessary for writing a still picture and the still picture data to the memory 61.

According to the second embodiment, the external control circuit 2 has a function of activating the positive voltage generation circuit 8 and the negative voltage generation circuit 9 on the basis of the control system (not shown) for the liquid crystal panel 1 sensing transition to the standby mode and a function of transferring the control signal necessary for writing the still picture and the still picture data.

In order to sense that the voltages of the positive voltage generation circuit 8 and the negative voltage generation circuit 9 reach the set levels VPP and VBB (setup completion), the positive voltage generation circuit 8 and the negative voltage generation circuit 9 may transmit setup completion signals to the external control circuit 2, or the setup may be regarded as completed through a lapse of a predetermined time (a time for one frame: 16.7 msec. in a case of 60 frames/sec., for example).

According to the second embodiment, the liquid crystal display writes the still picture data in the memory 61 after sensing transition to the standby operation mode (standby mode) and starting the positive voltage generation circuit 8 and the negative voltage generation circuit 9 so that the voltages of the positive voltage generation circuit 8 and the negative voltage generation circuit 9 reach the set levels VPP and VBB, whereby the positive voltage generation circuit 8 and the negative voltage generation circuit 9 completely rise while suppressing a through current when writing data in the memory 61 also when the positive voltage generation circuit 8 and the negative voltage generation circuit 9 are started after sensing transition to the standby operation mode. Thus, the data can be excellently written.

(Third Embodiment)

Figure 6:
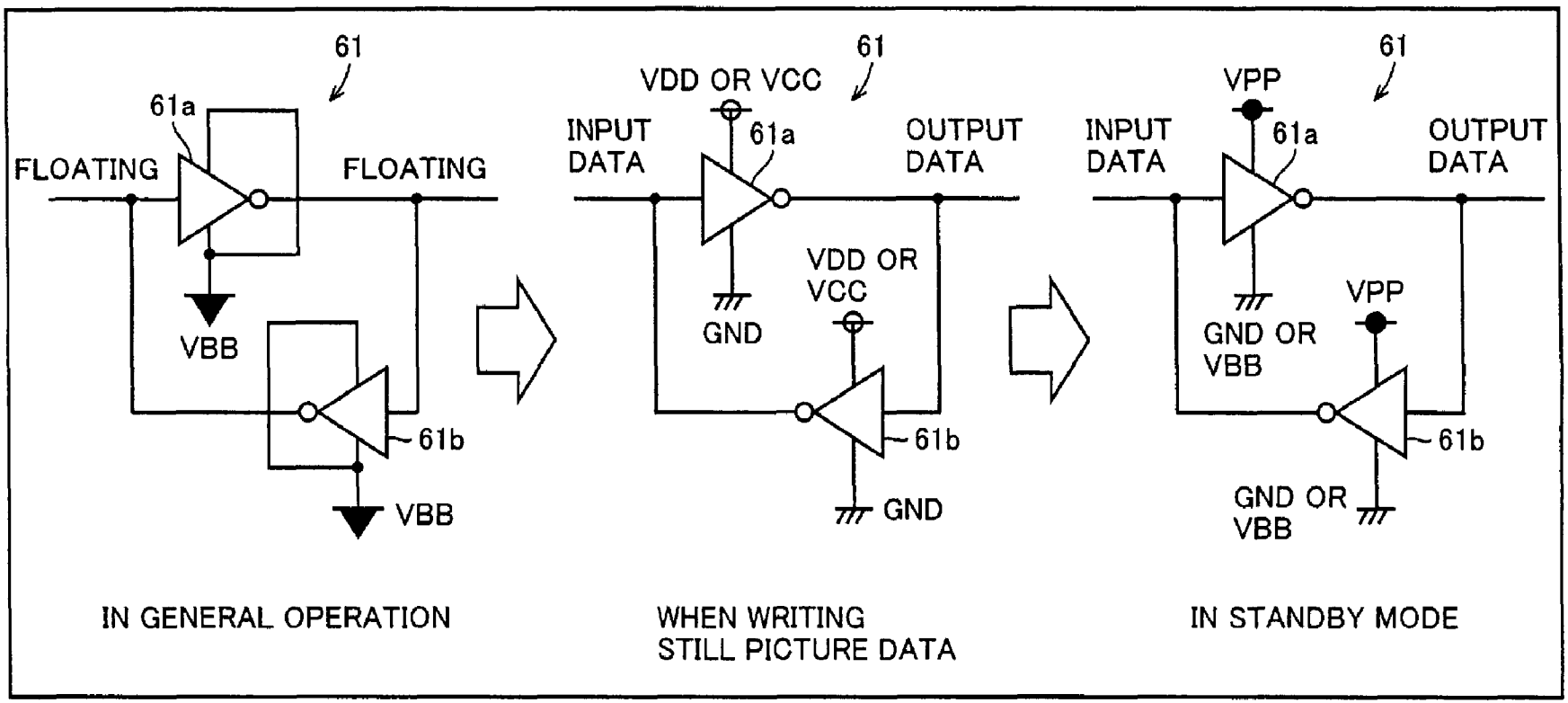
FIG. 6 is a circuit diagram for illustrating a method of controlling a liquid crystal display according to a third embodiment of the present invention.

Referring to FIG. 6, a method of controlling a liquid crystal display according to a third embodiment of the present invention is described with reference to power source allocation for a memory (SRAM) 61 making transition from a general operation mode to a standby mode. According to the third embodiment, a negative potential VBB is applied to two inverter circuits 61*a* and 61*b* forming the memory (SRAM) 61 in the general operation. Before directly applying a stepped-up voltage VPP in the standby mode from this state, a power source VDD for a liquid crystal panel 1 more stable than the positive voltage generation circuit 8 or a standby power source VCC is temporarily applied.

The power source VDD for the liquid crystal panel 1 or the standby power source VCC is switched to the stepped-up potential VPP after all still picture data are written. This is because a malfunction is readily caused if the power source VDD for the liquid crystal panel 1 or the standby power source VCC is switched to the stepped-up potential VPP while writing the still picture data.

According to the third embodiment, the liquid crystal display employs the stable power source VDD or VCC having higher current drivability than the positive voltage generation circuit 8 as the power source for the memory 61 when writing the still picture data in the memory 61 as hereinabove described, whereby the power source is not unstabilized also when a through current flows in data writing. Thus, data can be stably written in the memory 61. Further, the stepped-up voltage VPP of the positive voltage generation circuit 8 is not abruptly reduced when writing data in the memory 61. In addition, no through current flows in the standby state after the data writing, whereby current consumption can be reduced in the standby state.

Figure 7:
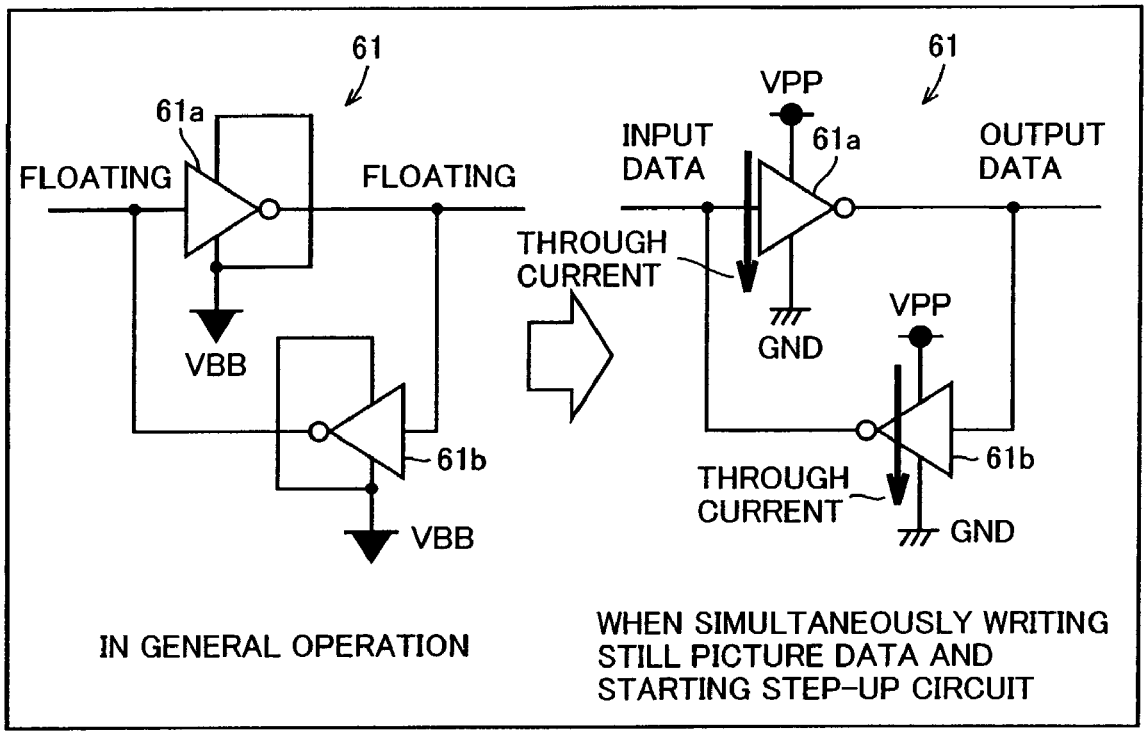
FIG. 7 is a circuit diagram for illustrating inconvenience caused when not employing the method of controlling a liquid crystal display according to the third embodiment shown in FIG. 6.
Figure 8:
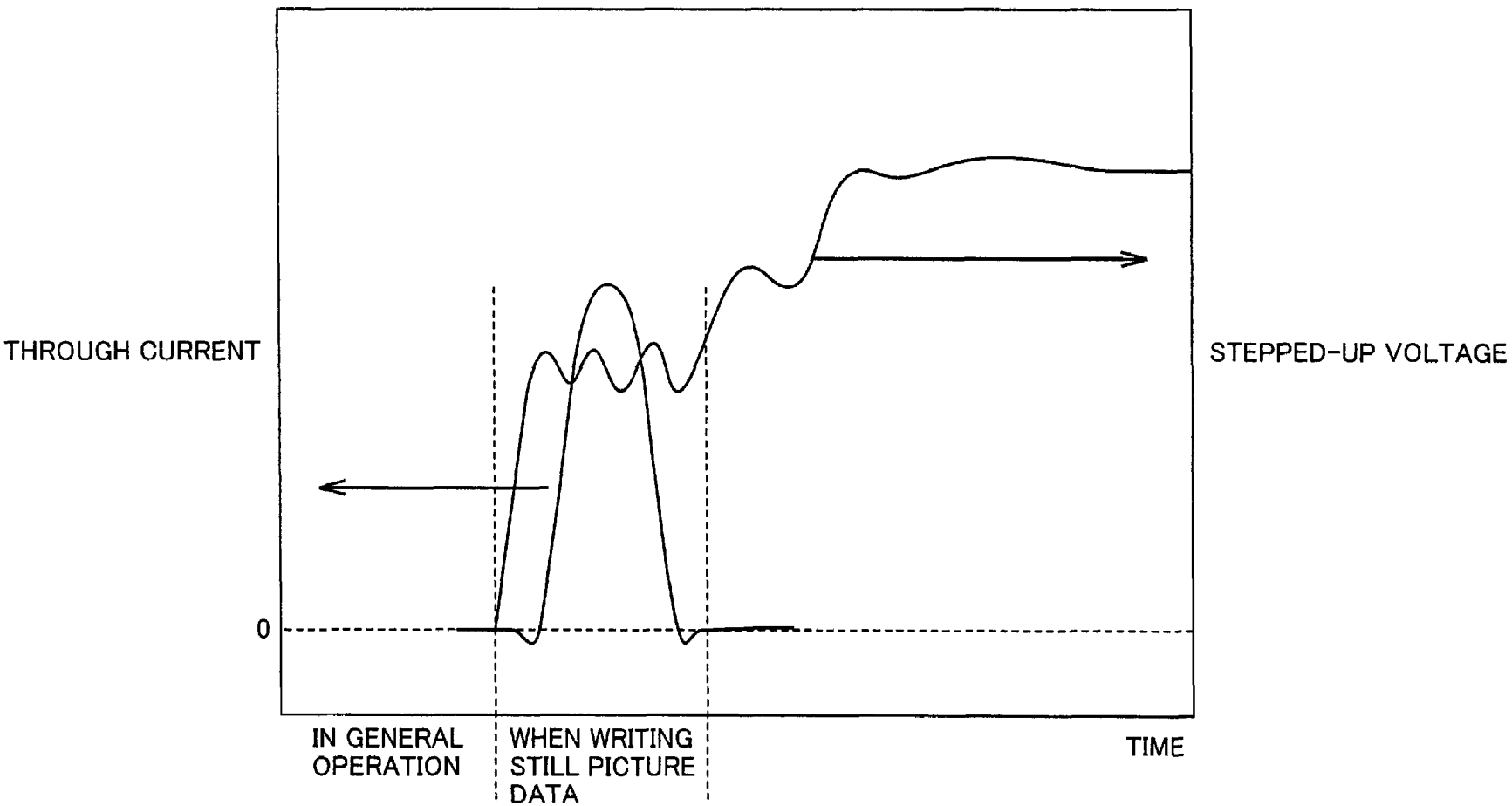
FIG. 8 is a correlation diagram illustrating the relation between time and through currents and stepped-up voltages corresponding to the circuit diagram shown in FIG. 7.

Inconvenience caused when not employing the structure of the third embodiment shown in FIG. 6 is now described with reference to FIGS. 7 and 8. When transition is directly made from a power source set value VBB in general operation to a power source set value VPP in a standby mode while simultaneously writing still picture data and starting the positive voltage generation circuit 8 as shown in FIG. 7, a through current is disadvantageously generated when writing the still picture data, as shown in FIG. 8. When such a through current is generated, the stepped-up power supply value VPP generated by the internal positive voltage generation circuit 8 having relatively small current drivability is unstabilized and hence it is difficult to write the still picture data.

In order to prevent such inconvenience, therefore, the liquid crystal display according to the third embodiment shown in FIG. 6 temporarily applies the power source VDD or VCC having high current drivability before directly applying the stepped-up potential VPP from the negative potential VBB in the general operation. Thus, the stable power source VDD or VCC having high current drivability is not unstabilized also when a through current flows when writing the still picture data as described above, whereby the still picture data can be excellently written as a result. The power source VDD or VCC having high current drivability is employed for data writing, whereby the stepped-up potential VPP generated in the internal positive voltage generation circuit 8 having relatively small current drivability is not rapidly reduced in data writing. After making transition to the standby mode upon completion of writing of the still picture data, current drivability is not much required. In this case, therefore, the stepped-up potential VPP stepped up by the internal positive voltage generation circuit 8 having relatively small current drivability can be employed with no problem.

(Fourth Embodiment)

Figure 9:
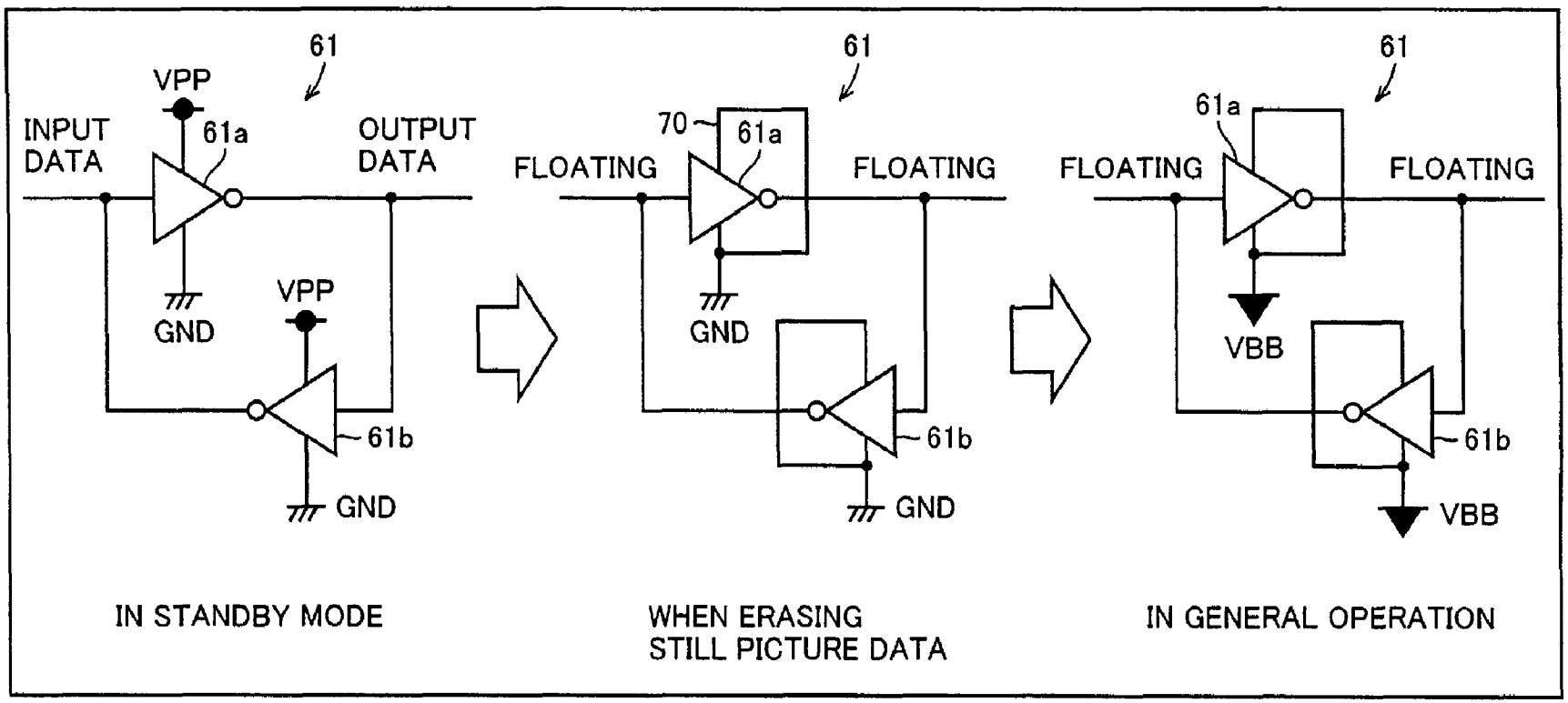
FIG. 9 is a circuit diagram for illustrating a method of controlling a liquid crystal display according to a fourth embodiment of the present invention.

Referring to FIG. 9, a method of controlling a liquid crystal display according to a fourth embodiment of the present invention is described with reference to power source allocation for a memory (SRAM) 61 making transition from a standby mode to a general operation mode. More specifically, a step-up node 70 is temporarily connected to a ground potential GND when switching a stepped-up voltage VPP in the standby mode to a negative potential VBB in the general operation. Thus, stepped-up charges stored in parasitic capacitance of the step-up node 70 are discharged, to erase still picture data. Thereafter the negative potential VBB for the general operation is applied.

The ground potential GND is switched to the potential VBB for the general operation before writing image data in the general operation.

According to the fourth embodiment, the step-up node 70 is temporarily set to the ground potential GND to be discharged before making transition from the standby operation mode to the general operation mode and thereafter a negative voltage generation circuit 9 is connected to the memory 61 as hereinabove described, whereby increase of current consumption can be suppressed when making transition from the standby operation mode to the general operation mode while a time when the negative potential VBB is unstabilized can be reduced.

Figure 10:
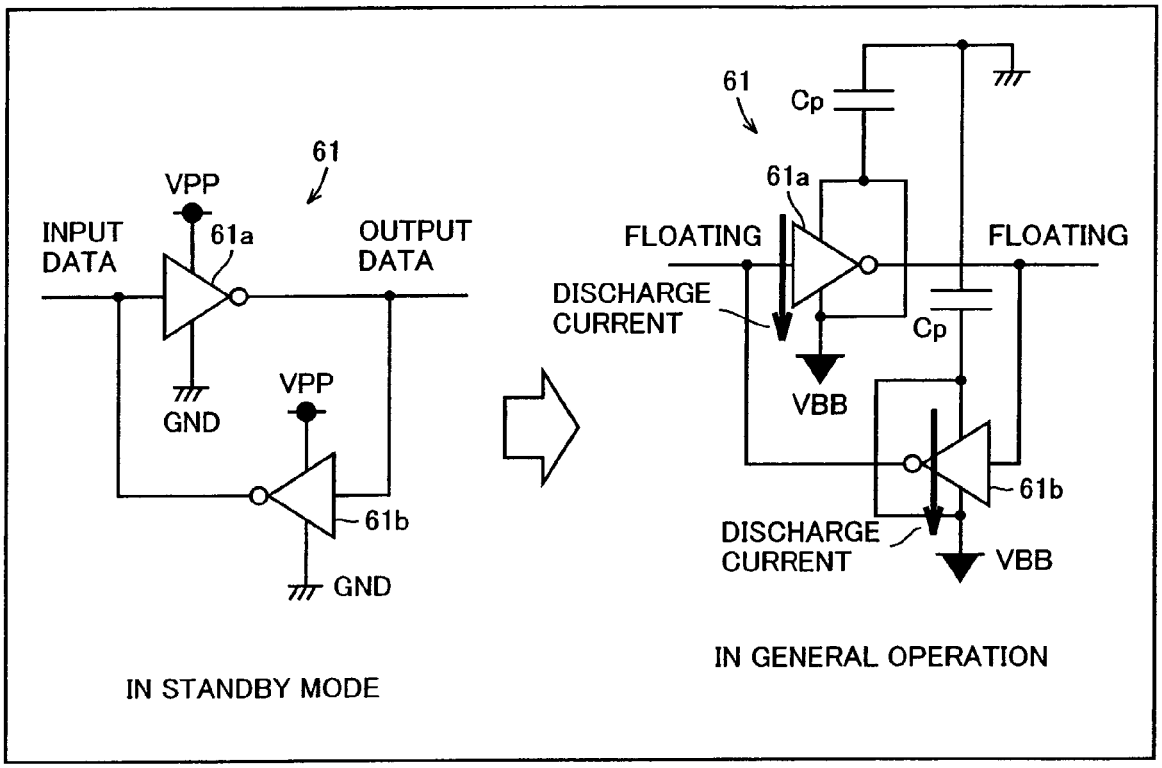
FIG. 10 is a circuit diagram for illustrating inconvenience caused when not employing the method of controlling a liquid crystal display according to the fourth embodiment shown in FIG. 9.
Figure 11:
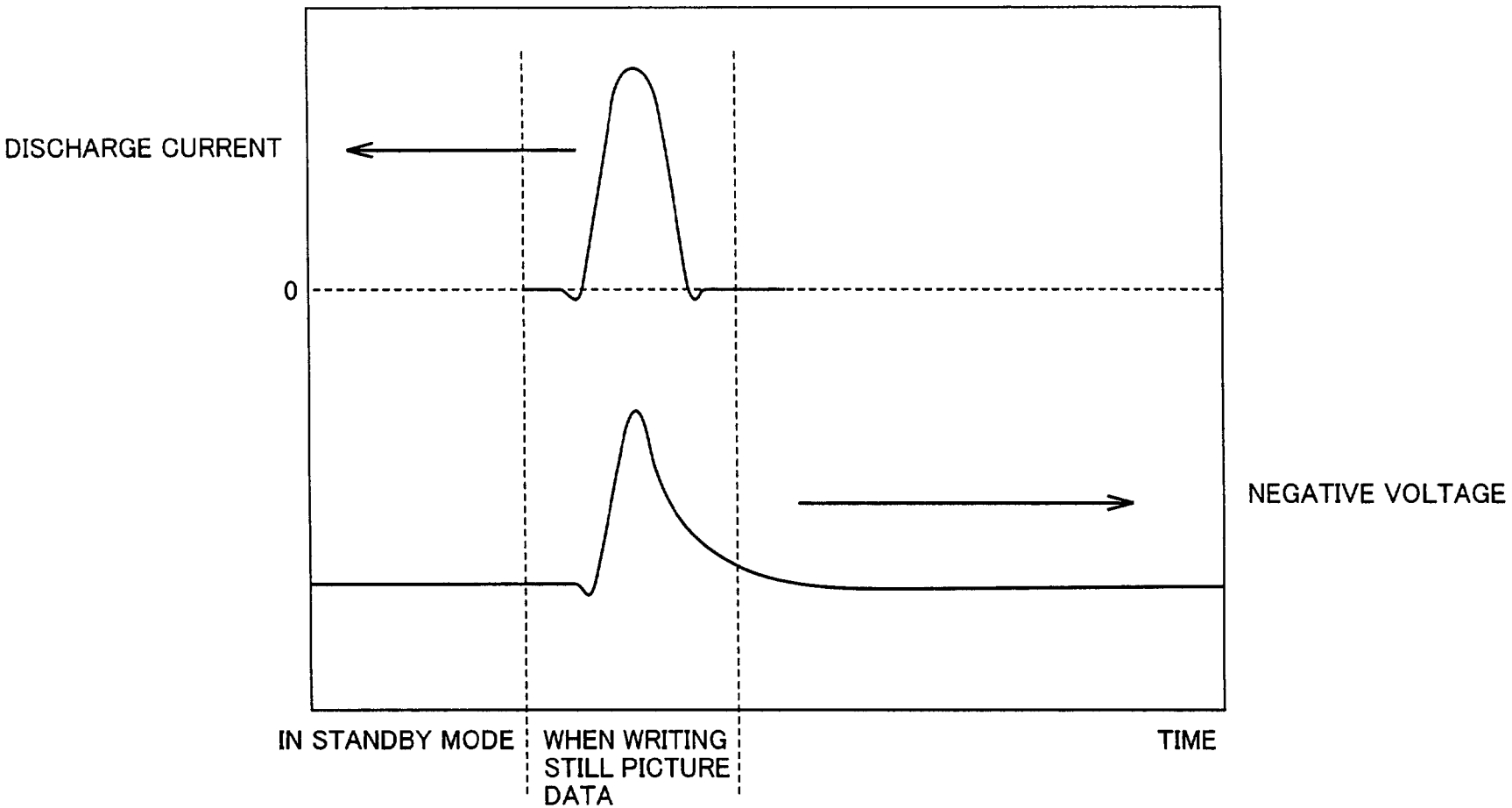
FIG. 11 is a correlation diagram illustrating the relation between time and through currents and stepped-up voltages corresponding to the circuit diagram shown in FIG. 10.

When transition is directly made from the power source set value VPP in the standby mode to the power source set value VBB in the general operation mode, stepped-up charges stored in a parasitic capacitor Cp flow toward the negative potential VBB as a current, as shown in FIG. 10. Consequently, a discharge current flows to increase current consumption as shown in FIG. 10, while the negative power source value VBB is rendered shallow (approached to a positive direction) and unstabilized as shown in FIG. 11.

According to the fourth embodiment shown in FIG. 9, therefore, the step-up node 70 is temporarily connected to the ground potential GND before switching the power supply set value VPP in the standby mode to the power supply set value VBB in the general operation mode thereby discharging the stepped-up charges stored in the parasitic capacitance of the step-up node 70, in order to prevent the aforementioned inconvenience. Thus, the time when the negative potential VBB for the general operation is unstabilized can be reduced and a discharge current in the general operation can be suppressed as hereinabove described, whereby increase of current consumption can be suppressed in the general operation.

Although the present invention has been described and illustrated in detail, it is clearly understood that the same is by way of illustration and example only and is not to be taken by way of limitation, the spirit and scope of the present invention being limited only by the terms of the appended claims.

While each of the above embodiments has been described with reference to a display consisting of a liquid crystal display (LCD), for example, the present invention is not restricted to this but is also applicable to another display such as an EL (electroluminescence) display so far as the same includes a memory in a pixel part.

While the liquid crystal display senses that the positive and negative voltage generation circuits 8 and 9 reach ultimate potentials by transmitting setup completion signals from the positive and negative voltage generation circuits 8 and 9 to the external control circuit 2 or through a lapse of a prescribed time in each of the aforementioned first and second embodiments, the present invention is not restricted to this but the display may alternatively sense setup completion of the positive and negative voltage generation circuits 8 and 9 by another method.

What is claimed is:

1. A display comprising:

a pixel part having a memory;

a power supply circuit formed on the same substrate as said pixel part for operating said memory, the power supply circuit activated to generate a set voltage value in response to a sensed transition to a standby operation mode of the display; and a control circuit writing data in said memory after the voltage of said power supply circuit reaches the set voltage value;

further comprising a scanning line driving circuit for driving scanning lines of the pixel part and a data line driving circuit for driving data lines of the pixel part, and the power supply circuit is not connected to the scanning line driving circuit and the data line driving circuit but connected to the memory of the pixel part.

2. A display comprising:

a pixel part having a memory;

a power supply circuit formed on the same substrate as said pixel part for operating said memory; and a control circuit writing data in said memory after the voltage of said power supply circuit reaches a set value; wherein said power supply circuit includes at least a positive voltage generation circuit, and a power source having higher current drivability than said positive voltage generation circuit is employed as the power source for said memory while said data is written in said memory, and said positive voltage generation circuit is employed as the power source for said memory after said data is completely written;

further comprising a scanning line driving circuit for driving scanning lines of the pixel part and a data line driving circuit for driving data lines of the pixel part, and the power supply circuit is not connected to the scanning line driving circuit and the data line driving circuit but connected to the memory of the pixel part.

3. The display according to claim 2, wherein said power source having higher current drivability than said positive voltage generation circuit includes either a display panel power source VDD or a standby power source VCC.

4. The display according to claim 1, wherein said power supply circuit includes a positive voltage generation circuit and a negative voltage generation circuit, and said negative voltage generation circuit is connected to said memory after temporarily setting a node of said positive voltage generation circuit to a ground potential thereby discharging the same when making transition from a standby operation mode to a general application operation mode.

5. The display according to claim 1, wherein said control circuit includes an external control circuit for transferring still picture data and a control signal to said memory when writing said data in said memory.

6. The display according to claim 5, wherein said external control circuit further transmits a signal for starting said power supply circuit to said power supply circuit.

7. The display according to claim 1, wherein said memory includes an SRAM.

8. The display according to claim 1, including either a liquid crystal display or an EL display.

9. A method of controlling a display comprising a pixel part having a memory and a power supply circuit formed on the same substrate as said pixel part for operating said memory, comprising steps of:

sensing a transition to a standby operation mode of the display;

activating said power supply circuit to generate a set voltage value in response to sensing the transition; and writing data in said memory after the voltage of said power supply circuit reaches said set voltage value;

further comprising a scanning line driving circuit for driving scanning lines of the pixel part and a data line driving circuit for driving data lines of the pixel part, and the power supply circuit is not connected to the scanning line driving circuit and the data line driving circuit but connected to the memory of the pixel part.

10. The method of controlling a display according to claim 9, wherein said step of writing said data in said memory includes a step of transferring still picture data and a control signal to said memory thereby writing said data.

11. The method of controlling a display according to claim 9, wherein said step of making the voltage of said power supply. circuit reach said set value includes a step of transmitting a setup completion signal from said power supply circuit to said control circuit thereby sensing that the voltage of said power supply circuit reaches said set value.

12. The method of controlling a display according to claim 9, wherein said step of making the voltage of said power supply circuit reach said set value includes a step of sensing that the voltage of said power supply circuit reaches said set value on the basis of a lapse of a prescribed time after starting of said power supply circuit.

13. The method of controlling a display according to claim 9, wherein said step of making the voltage of said power supply circuit reach said set value includes a step of starting said power supply circuit simultaneously with power supply to a display panel, and said step of writing said data in said memory includes a step of performing operation in a general application operation mode after the voltage of said power supply circuit reaches said set value and thereafter writing said data in said memory when making transition to a standby operation mode.

14. The method of controlling a display according to claim 9, wherein said step of making the voltage of said power supply circuit reach said set value includes a step of starting said power supply circuit after sensing transition to a standby operation mode, and said step of writing said data in said memory includes a step of writing said data in said memory after the voltage of said power supply circuit reaches said set value in said standby operation mode.

15. The method of controlling a display according to claim 14, wherein said step of making the voltage of said power supply circuit reach said set value includes a step of transmitting a setup completion signal from said power supply circuit to said control circuit thereby sensing that the voltage of said power supply circuit reaches said set value.

16. The method of controlling a display according to claim 14, wherein said step of making the voltage of said power supply circuit reach said set value includes a step of sensing that the voltage of said power supply circuit reaches said set value on the basis of a lapse of a prescribed time after starting of said power supply circuit.

17. A method of controlling a display comprising a pixel part having a memory and a power supply circuit formed on the same substrate as said pixel part for operating said memory, comprising steps of:

making the voltage of said power supply circuit reach a set value; and writing data in said memory after the voltage of said power supply circuit reaches said set value; wherein said power supply circuit includes at least a positive voltage generation circuit, and said step of writing said data in said memory includes a step of employing a power source having higher current drivability than said positive voltage generation circuit as the power source for said memory while writing said data in said memory and employing said positive voltage generation circuit as the power source for said memory after writing said data;

further comprising a scanning line driving circuit for driving scanning lines of the pixel part and a data line driving circuit for driving data lines of the pixel part, and the power supply circuit is not connected to the scanning line driving circuit and the data line driving circuit but connected to the memory of the pixel part.

18. The method of controlling a display according to claim 17, wherein said power source having higher current drivability than said positive voltage generation circuit includes either a display panel power source VDD or a standby power source VCC.

19. A method of controlling a display comprising a pixel part having a memory and a power supply circuit formed on the same substrate as said pixel part for operating said memory, comprising steps of:

making the voltage of said power supply circuit reach a set value; and writing data in said memory after the voltage of said power supply circuit reaches said set value; wherein said power supply circuit includes a positive voltage generation circuit and a negative voltage generation circuit, said method further including a step of connecting said negative voltage generation circuit to said memory after temporarily setting a node of said positive voltage generation circuit to a ground potential thereby discharging the same when making transition from a standby operation mode to a general application operation mode.

* * * * *